US007794570B2

(12) United States Patent
Ewald

(10) Patent No.: US 7,794,570 B2
(45) **Date of Patent: *Sep. 14, 2010**

(54) HEADBOX APPARATUS FOR A PAPERMAKING MACHINE

(75) Inventor: James L Ewald, Stuart, FL (US)

(73) Assignee: Paperchine Inc., Rockton, IL (US)

( * ) Notice: Subject to any disclaimer, the term of this patent is extended or adjusted under 35 U.S.C. 154(b) by 644 days.

This patent is subject to a terminal disclaimer.

(21) Appl. No.: 11/642,054

(22) Filed: Dec. 19, 2006

(65) Prior Publication Data

US 2007/0181277 A1 Aug. 9, 2007

Related U.S. Application Data

(60) Provisional application No. 60/763,439, filed on Jan. 30, 2006.

(51) Int. Cl.
*D21F 1/06* (2006.01)

(52) U.S. Cl. ..... 162/343; 162/336

(58) Field of Classification Search ..... 162/343, 162/336

See application file for complete search history.

(56) References Cited

U.S. PATENT DOCUMENTS

| | | | |
|---|---|---|---|
| 4,617,091 | A | 10/1986 | Rodal et al. |
| 5,110,416 | A | 5/1992 | Linsuri et al. |
| 5,147,509 | A | 9/1992 | Kuragasaki et al. |
| 5,183,537 | A | 2/1993 | Hergert et al. |
| 6,099,692 | A | 8/2000 | Weisshuhn et al. |
| 6,248,214 | B1 | 6/2001 | Stotz et al. |
| 6,383,614 | B1 | 5/2002 | Carson et al. |
| 6,432,275 | B1 | 8/2002 | Huovila et al. |
| 6,475,344 | B1 | 11/2002 | Aidun |
| 6,902,651 | B2 | 6/2005 | Fujiki et al. |

*Primary Examiner*—Mark Halpern
(74) *Attorney, Agent, or Firm*—David J. Archer

(57) ABSTRACT

A headbox apparatus is disclosed for a papermaking machine. The headbox apparatus defines a flow path for stock flowing between an upstream header and a downstream slice lip. The apparatus includes a plurality of elements which are anchored within the flow path between the header and the slice lip. Each element and an adjacent element of the plurality of elements defines therebetween a flow tube for the flow therethrough of the stock. The flow tube has an upstream portion and a downstream portion that gradually widens in a direction from the header to the slice lip.

27 Claims, 12 Drawing Sheets

HEADBOX APPARATUS FOR A PAPERMAKING MACHINE

CROSS REFERENCE TO RELATED APPLICATION

The present application is a Complete application to Provisional application U.S. Ser. No. 60/763,439 filed Jan. 30, 2006. All the disclosure of U.S. Ser. No. 60/763,439 is incorporated herein by reference.

BACKGROUND OF THE INVENTION

1. Field of the Invention

The present invention relates to a headbox apparatus for a papermaking machine. More specifically, the present invention relates to a headbox apparatus that defines a flow path for stock flowing between an upstream header and a downstream slice lip.

2. Background Information

In a headbox of a papermaking machine, a vertical channel flow restriction device is located inside the headbox and distributes a uniform flow of fluid from the headbox delivery system to the headbox nozzle. The vertical channel flow restriction device is located between the pond sides and is trapped by the apron support structure and the top of the headbox nozzle. The fluid or stock is accelerated through the vertical channel openings into rectangular chambers located adjacent to one another. The discharge side of the vertical channel flow restriction device is nearly 100% open area into the headbox nozzle. The vertical openings provide a more uniform flow distribution requiring less mixing of individual flow streams and a uniform pressure drop across the distributor which produces a better basis weight profile.

The vertical channel flow restriction device is constructed from either metallic or non metallic material as the segmented design makes cross machine thermal expansion less critical than previous designs. The flow passages in the channel flow restriction device are smooth in order to prevent fiber from adhering to the surfaces.

In the headbox of the present invention, the channel flow restriction device can be constructed from multiple segments or from a single piece of material. When constructed from multiple pieces, the vertical channel flow restriction device can be welded or glued, or simply by using locating devices and clamping forces. The vertical channel flow restriction device can utilize a continuous channel from the apron floor to the slice roof, or can be divided into individual stratified channels to divide the flow for purposes of different stock supply, or the use of turbulence control vanes in the slice region of the headbox.

The multiple pieces stacked together may still be trough bolted for structural rigidity by placing each layer of flow restriction device above one another keeping the channels and solid areas in line.

The channel flow restriction device tending and drive side elements, or multiple tending and drive side elements near the tending and drive side walls, may include a mechanism that alters their position thus altering the flow in their adjacent channels. This flow alteration provides a tool for controlling the fluid velocity and volume thus altering the fiber orientation. This alteration may either be the entrance size of these end channels, or modification of the inlet condition of these end channels.

The restriction device segments are fixed in location inside the headbox by locating devices. The upstream surfaces have a series of vertical channels located on an equal pitch across the entire width of the headbox. The flow elements can be designed such that the width of the channel can be easily changed. Changing the channel width changes the velocity and pressure drop for a given flow entering the vertical channel flow restriction device resulting in improved flow distribution.

The vertical channel flow restriction device is designed such that the range of fluid velocities in the initial section of the tube bank is between 3 and 50 feet per second. The exiting velocity range from the vertical tube bank is 1 to 20 feet per second.

The vertical channel flow restriction device can be fed from either a cross machine header or multiple flow injection hoses and can be used in combination with a dilution control of the flow leading to the flow restriction segments, or with dilution control fed within the flow restriction segments themselves. When used with a cross machine header, the segments themselves may contain a series of holes or slots that can deliver dilution control water into the cross machine header into the flow channel, or into the expansion portion of the element.

More specifically, the headbox apparatus according to the present invention includes the following features:

1. The vertical flow restriction device minimizes the mixing requirements of multiple individual tubes.

2. The mixing of flows is primarily in the cross machine direction, reducing rotational flow vortexes and maximizes cross machine mixing.

3. The vertical flow restriction device is constructed from one or multiple pieces.

4. The vertical channel flow restriction device is constructed with a series of channels on equal or near equal pitch across the entire width of the headbox 5. The tending side and drive side elements include a mechanism to alter the flow rate through these channels either by width or entrance configuration.

6. The vertical channel width can be easily modified to increase or decrease the pressure drop across the flow restriction device.

7. The vertical tube bank is located inside the headbox in the wet end side of the nozzle between the pond sides, apron support structure and nozzle roof.

8. The vertical flow restriction device is constructed of multiple MD and CD direction adjacent zones with varying open areas.

9. The vertical flow restriction device discharge side has greater than 85% open area into the nozzle area of the headbox.

10. The vertical flow restriction device can be utilized in headboxes where the delivery of fluid to the headbox is completed by means of a tapered header or a multiple tube/hose delivery system.

11. The vertical flow restriction device can be operated in conjunction with a dilution control system or without a dilution control system 12. The vertical flow restriction device may contain multiple holes or channels to deliver dilution water through the element and into the tapered header or into other areas of the element.

More particularly, a conventional headbox distributor uses a tube array to spread the pulp slurry as uniformly as possible across the width of a paper machine headbox prior to the start of the drainage or other thickening process. The tube array is generally made up of individual round inlet tubes mounted is some manner to cause acceleration of the flow into each tube from a cross machine header or other form of supply of the slurry prior to the tube array. The pressure drop from the acceleration of the flow at the inlet of each tube within the array is critical to the uniformity of the flow within each tube and therefore to the uniformity of the cross machine uniformity of the headbox in general. This acceleration of the flow is also a factor in the operational cleanliness of the headbox operation as well as flow stability and uniformity. The exit end of a typical tube array may take on many shapes (round. hexagonal. rectangular or square or other) but eventually the flows exiting each individual tube must be re-joined prior to or within the nozzle of the headbox prior to discharge to the drainage area. The reorientation of the round tube entrance flow to the eventual rectangular shape of the nozzle will create disturbances in the flow in all directions. These disturbances must be damped or reduced in some way prior to discharge out the slice so as not to cause nonuniformities in the paper web.

The purpose of the present invention is to create the necessary pressure drop and subsequent uniform cross machine flow distribution using only vertical channels in the flow distributor. This will minimize non-cross machine flow disturbances improving cross machine uniformity of the flow. The use of only vertical channels also improves the cross machine characteristics of the fiber slurry by minimizing non cross machine forces on the fibers by the fluid flow. The design is equally applicable to headboxes using dilution to control the headbox profile or other mechanical profile control techniques.

Further advantages of this invention are simplicity of manufacturing using easily manufactured turbulence generating devices and improved structural stiffness within the headbox to withstand internal pressures of the fluid flow.

Therefore, the primary feature of the present invention is the provision of a headbox apparatus that overcomes the problems associated with the prior art headboxes and which makes a significant contribution to the papermaking art.

Another feature of the present invention is the provision of a headbox apparatus for a papermaking machine that is easier and less costly to manufacture when compared with prior art headboxes.

Other features and advantages of the present invention will be readily apparent to those skilled in the art by a consideration of the detailed description of a preferred embodiment of the present invention contained herein.

SUMMARY OF THE INVENTION

The present invention relates to a headbox apparatus for a papermaking machine. The headbox apparatus defines a flow path for stock flowing between an upstream end and a downstream end of the apparatus. The apparatus includes a plurality of elements which are anchored within the flow path between the upstream end and the downstream end. Each element and an adjacent element of the plurality of elements define therebetween a flow tube for the flow therethrough of the stock. The flow tube has an upstream portion and a downstream portion that gradually widens in a direction from the header to the slice lip.

In the present invention, the term upstream end and downstream end of the apparatus are to be understood as including a header and a slice lip respectively.

In a more specific embodiment of the present invention, each of the elements is fabricated from a plastics material. More specifically, the plastics material is a high molecular weight polyethylene.

In alternative arrangements, the elements are fabricated from graphite composite material, fiberglass material, ceramic material, cermet material or stainless steel. Also, the elements in a further alternative arrangement are fabricated from TEFLON. TEFLON is a Registered Trademark owned by Du Pont Corporation.

It will be understood by those skilled in the art that the elements of the present invention may be fabricated from any suitable metallic or non metallic material.

Also, each element defines an upstream and a downstream bore. A first anchor rod extends through the upstream bore. Additionally, a second anchor rod extends through the downstream bore such that the anchor rods anchors the element within the headbox apparatus.

More particularly, the anchor rods extend substantially normal to the direction from the header to the slice lip and each element has a first and a second side, the first side being of mirror image configuration relative to the second side.

Also, each element is disposed in alignment in the direction relative to an adjacent element.

In another embodiment of the present invention, each element is disposed out of alignment in the direction relative to an adjacent element such that the element and the adjacent element are offset relative to each other.

The flow tube extends in the direction and the upstream portion is of rectangular cross sectional configuration.

Moreover, the upstream portion has an upstream and a downstream end, the upstream portion being of uniform cross sectional configuration between the upstream and downstream ends thereof.

Additionally, the downstream portion has an upstream extremity and a downstream extremity, the upstream extremity of the downstream portion having a cross sectional area which is greater than a cross sectional area of the upstream portion.

Also, the upstream extremity of the downstream portion has a cross sectional area which is less than a cross sectional area of the downstream extremity.

Furthermore, the cross sectional area of the downstream portion uniformly increases in the direction between the upstream and the downstream extremities of the downstream portion.

In one embodiment of the present invention, the flow tube also includes an intermediate portion having a first and a second end. The intermediate portion has a cross sectional area which is uniform from the first to the second end thereof. Also, the downstream end of the upstream portion defines a chamfered transition which is disposed adjacent to the first end of the intermediate portion such that the stock flows progressively through the upstream portion then through the chamfered transition and then through the intermediate portion and then through the downstream portion.

Additionally, the headbox apparatus further includes an edge flow element having an upstream and a downstream termination. The edge flow element is pivotally anchored adjacent to the downstream termination thereof such that selective pivotal movement of the edge flow element is permitted. The arrangement is such that a cross sectional area of an edge flow tube defined between the edge flow element and an adjacent element of the plurality of elements is selectively adjustable.

Also, the headbox according to the present invention may include a trailing element pivotally secured adjacent to the downstream extremity of the downstream portion.

Additionally, the headbox according to the present invention may include a dilution control for controlling the cross machine consistency profile of the resultant web.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF PREFERRED EMBODIMENT

Figure 1:
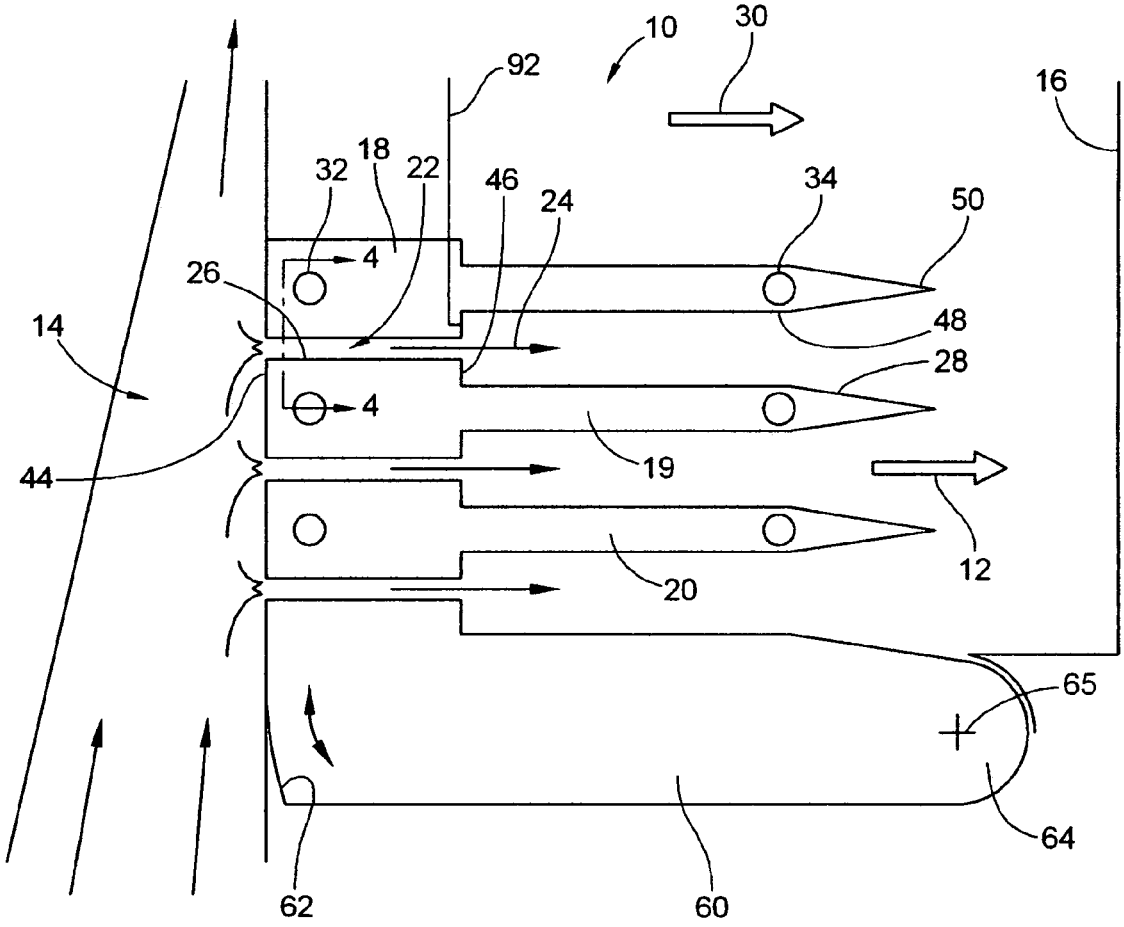
FIG. 1 is a top plan view of a headbox apparatus for a papermaking machine according to the present invention.

FIG. 1 is a top plan view of a headbox apparatus generally designated 10 for a papermaking machine according to the present invention. As shown in FIG. 1, the headbox apparatus 10 defines a flow path indicated by the arrow 12 for stock flowing between an upstream end or header 14 and a downstream end or slice lip 16. The apparatus 10 includes a plurality of elements 18, 19 and 20 which are anchored within the flow path 12 between the header 14 and the slice lip 16. Each element such as the element 18 and an adjacent element 19 of the plurality of elements 18-20 define therebetween a flow tube generally designated 22 for the flow therethrough, as indicated by the arrow 24, of the stock. The flow tube 22 has an upstream portion 26 and a downstream portion 28 that gradually widens in a direction, as indicated by the arrow 30, from the header 14 to the slice lip 16.

In a more specific embodiment of the present invention, each of the elements 18-20 is fabricated from a plastics material. More specifically, the plastics material is a high molecular weight polyethylene.

In alternative arrangements, the elements 18-20 are fabricated from graphite composite material, fiberglass material, ceramic material, cermet material or stainless steel. Also, the elements in a further alternative arrangement are fabricated from TEFLON. TEFLON is a Registered Trademark owned by the Du Pont Corporation.

It will be understood by those skilled in the art that the elements 18-20 may be fabricated from any suitable metallic or non metallic material.

Also, each element such as element 18 defines an upstream bore 32 and a downstream bore 34.

Figure 2:
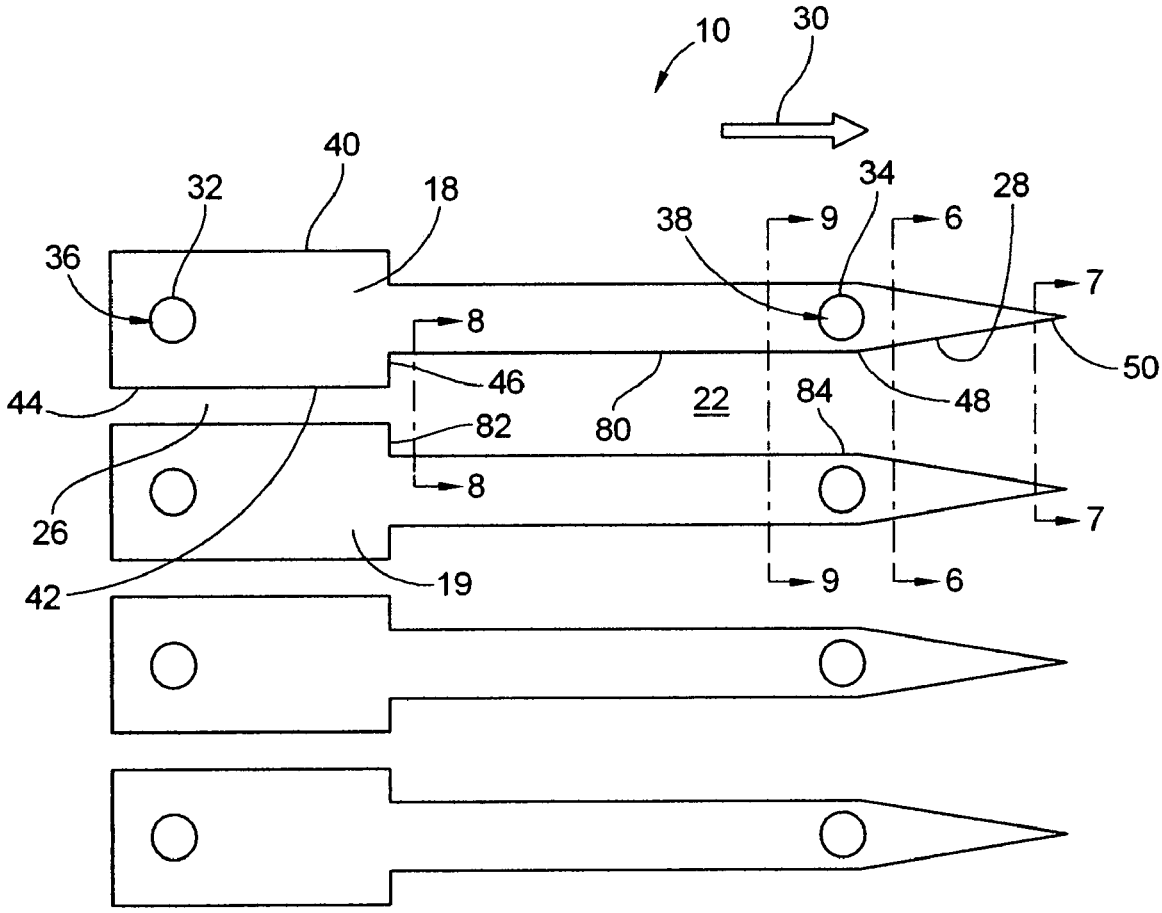
FIG. 2 is an enlarged view similar to that shown in FIG. 1 and shows in more detail the bores for anchoring the elements.

FIG. 2 is an enlarged view similar to that shown in FIG. 1 and shows in more detail the bores 32 and 34. As shown in FIG. 2, a first anchor rod 36 extends through the upstream bore 32. Additionally, a second anchor rod 38 extends through the downstream bore 34 such that the anchor rods 36 and 38 anchor the element 18 within the headbox apparatus 10.

The anchor rods 36 and 38 extend substantially normal to the direction as indicated by the arrow 30. As shown in FIG. 2, each element such as element 18 has a first and a second side 40 and 42 respectively. The first side 40 is of mirror image configuration relative to the second side 42.

Also, each element such as element 18 is disposed in alignment in the direction 30 relative to the adjacent element 19.

Figure 3:
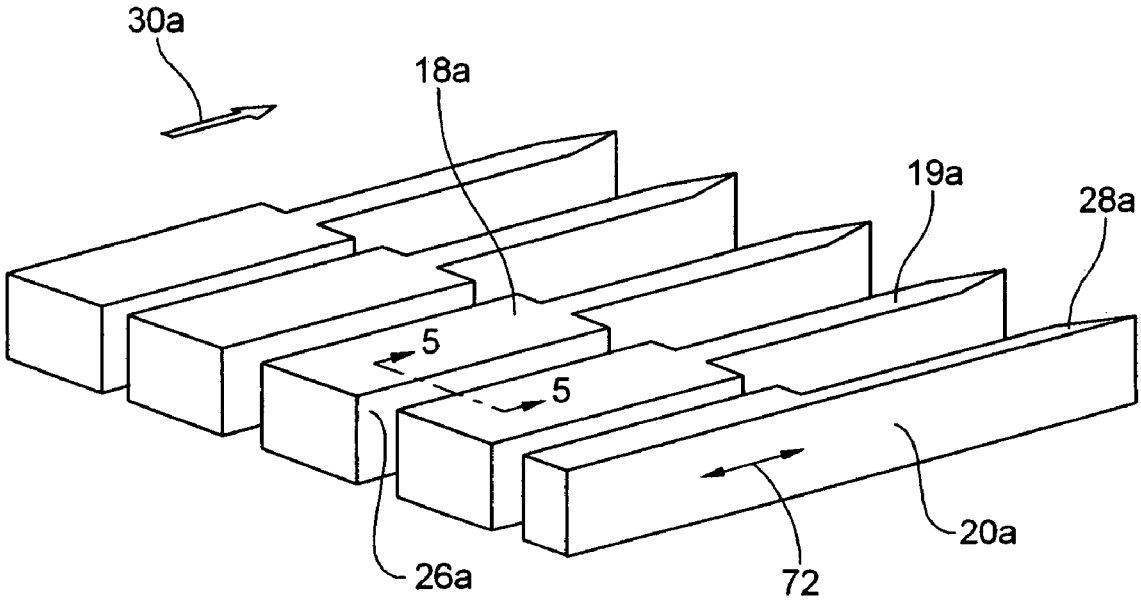
FIG. 3 is a perspective view showing another embodiment of the present invention.

FIG. 3 is a perspective view showing another embodiment of the present invention. As shown in FIG. 3, an element such as element **20*a* is disposed, as shown in phantom outline, out of alignment, in the direction 30*a* relative to an adjacent element 19*a* such that the element 20*a* and the adjacent element 19*a* are offset relative to each other. As shown in FIG. 3, the element 20*a* is adjustable as indicated by the arrow 72 so that the element 20*a* is selectively movable in a direction upstream or downstream relative to the adjacent element 19*a***

Figures 4, 5, 6, 7, 8, 9:
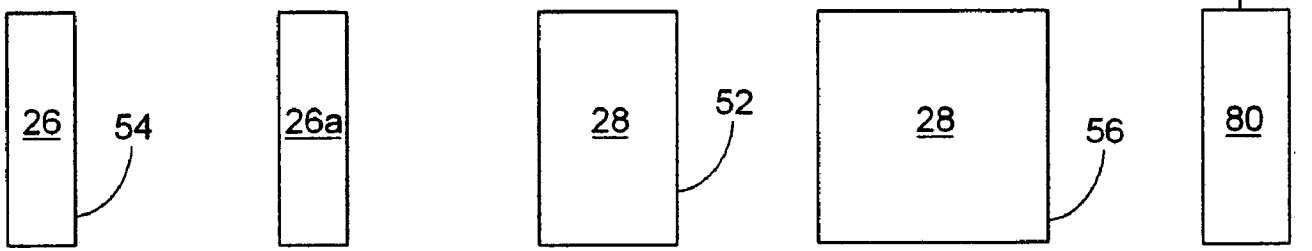
FIG. 4 is a sectional view taken on the line 4-4 of FIG. 1.
FIG. 5 is a sectional view taken on the line 5-5 of FIG. 3.
FIG. 6 is a sectional view taken on the line 6-6 of FIG. 2.
FIG. 7 is a sectional view taken on the line 7-7 of FIG. 2.
FIG. 8 is a sectional view taken on the line 8-8 of FIG. 2.
FIG. 9 is a sectional view taken on the line 9-9 of FIG. 2.

FIG. 4 is a sectional view taken on the line 4-4 of FIG. 1. As shown in FIG. 4, the upstream portion 26 is of rectangular cross sectional configuration.

FIG. 5 is a sectional view taken on the line 5-5 of FIG. 3. As shown in FIG. 3, the upstream portion **26*a*** is of rectangular cross sectional configuration.

As shown in the embodiment of FIGS. 1-2, the upstream portion 26 has an upstream and a downstream end 44 and 46 respectively. The upstream portion 26 is of uniform cross sectional configuration between the upstream and downstream ends 44 and 46 thereof.

Additionally, the downstream portion 28 has an upstream extremity 48 and a downstream extremity 50.

FIG. 6 is a sectional view taken on the line 6-6 of FIG. 2. As shown in FIG. 6, the upstream extremity 48 of the downstream portion 28 has a cross sectional area 52 which is greater than a cross sectional area 54 of the upstream portion 26 as shown in FIG. 4.

FIG. 7 is a sectional view taken on the line 7-7 of FIG. 2. As shown in FIG. 6, the upstream extremity 48 of the downstream portion 28 has a cross sectional area 52 which is less than a cross sectional area 56 of the downstream extremity 50 as shown in FIG. 7.

Furthermore, as shown in FIGS. 2, 6 and 7, the cross sectional area 52 to 56 of the downstream portion 28 progressively or uniformly increases in the direction 30 between the upstream and the downstream extremities 48 and 50 respectively of the downstream portion 28.

As shown in FIG. 2, an intermediate portion 80 of the flow tube 22 extends between the upstream portion 26 and the downstream portion 28 of the flow tube 22. The intermediate portion 80 has a first and a second end 82 and 84 respectively.

FIG. 8 is a sectional view taken on the line 8-8 of FIG. 2. As shown in FIG. 8, the intermediate portion 80 has a rectangular cross sectional configuration 86 that has a larger cross sectional area than the cross sectional area 54 of the upstream portion 26 shown in FIG. 4.

FIG. 9 is a sectional view taken on the line 9-9 of FIG. 2. As shown in FIG. 9, the intermediate portion 80 has a rectangular cross sectional area 88 that is substantially the same as the cross sectional area 86 shown in FIG. 8. Thus, the intermediate portion 80 is of substantially uniform cross sectional configuration from the first end 82 to the second end 84 thereof.

Figure 10:
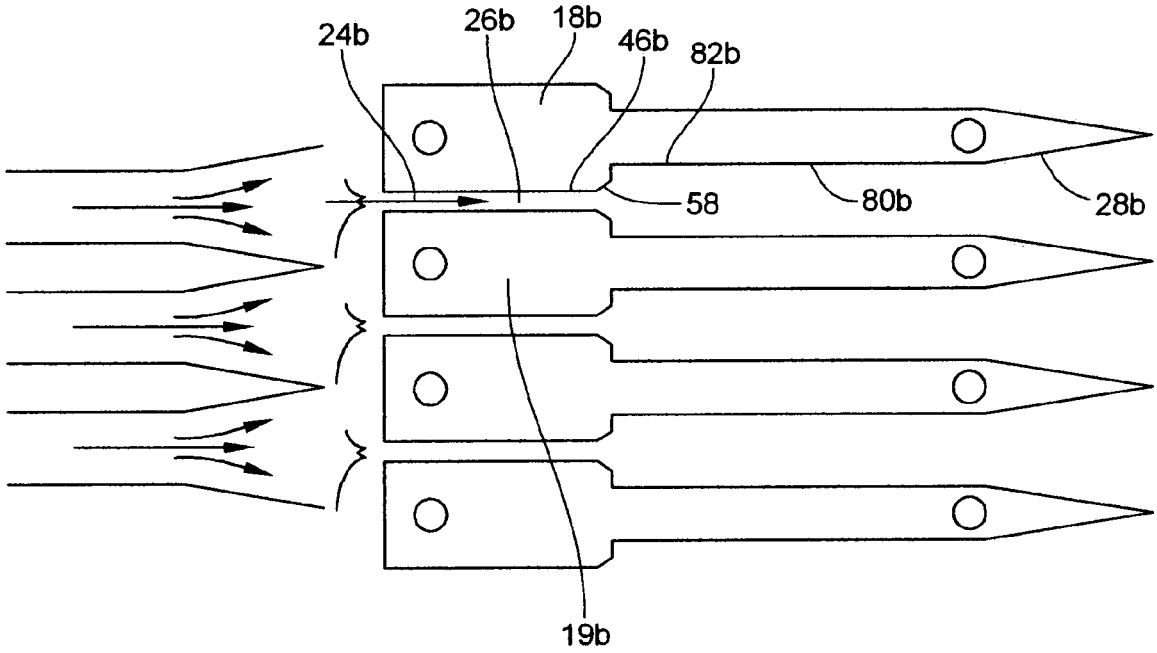
FIG. 10 is a top plan view which is similar to that shown in FIG. 2 but shows another embodiment of the present invention.

FIG. 10 is a top plan view which is similar to that shown in FIG. 2 but shows another embodiment of the present invention. As shown in FIG. 10, the downstream end 46*b* of the upstream portion 26*b* defines a chamfered transition 58 which is disposed adjacent to the first end 82*b* of the intermediate portion 80*b* such that the stock flows as indicated by the arrow 24*b* through the upstream portion 26*b* then through the chamfered transition 58 and then through the intermediate portion 80*b* to the downstream portion 28*b*.

As shown in FIG. 1, the headbox apparatus 10 further includes an edge flow element 60 having an upstream and a downstream termination 62 and 64 respectively. The edge flow element 60 is pivotally anchored about a pivotal axis 65 adjacent to the downstream termination 64.

Figure 11:
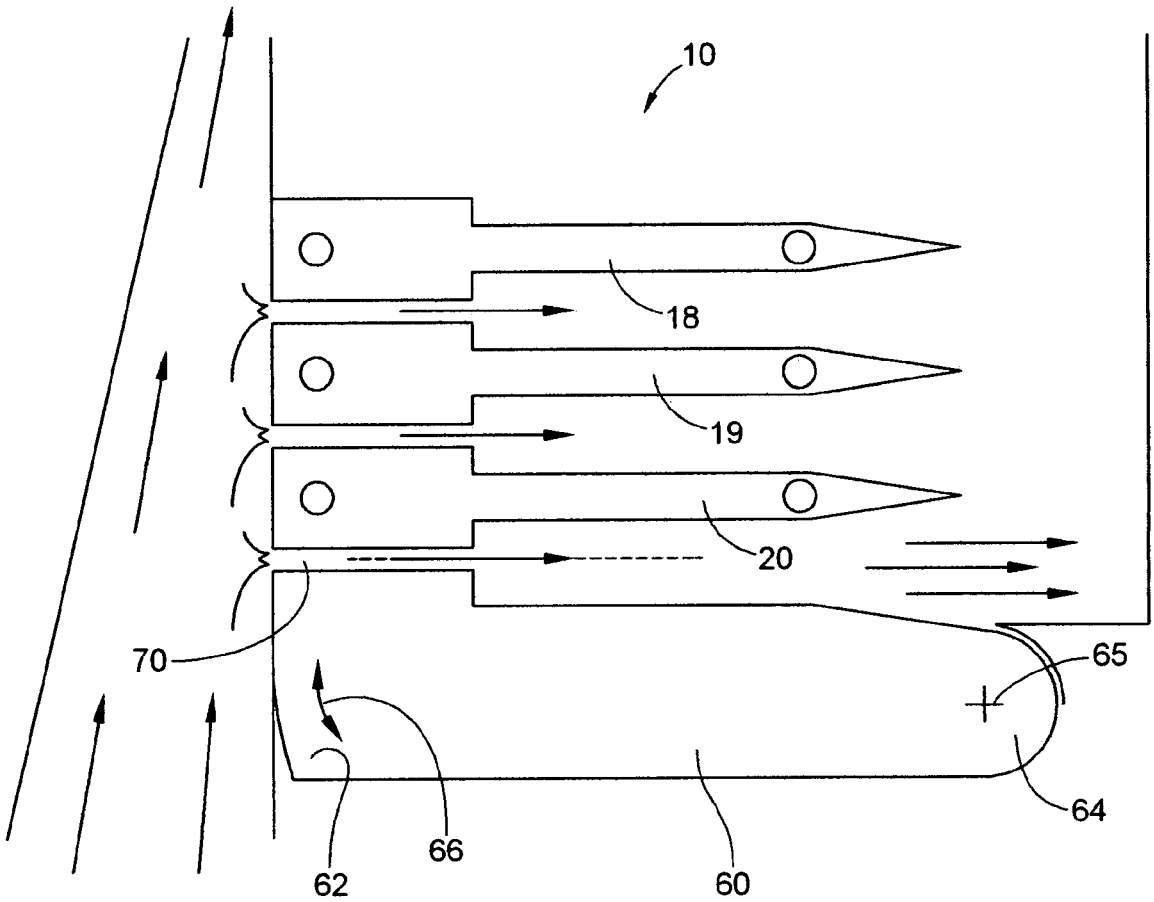
FIG. 11 is a top plan view of the edge flow element.

FIG. 11 is a top plan view of the edge flow element 60. As shown in FIG. 11, the arrangement is such that selective pivotal movement, as indicated by the arrow 66, of the edge flow element 60 is permitted. The arrangement is such that a cross sectional area of an edge flow tube 70 defined between the edge flow element 60 and an adjacent element 20 of the plurality of elements 18-20 is selectively adjustable.

Figure 12:
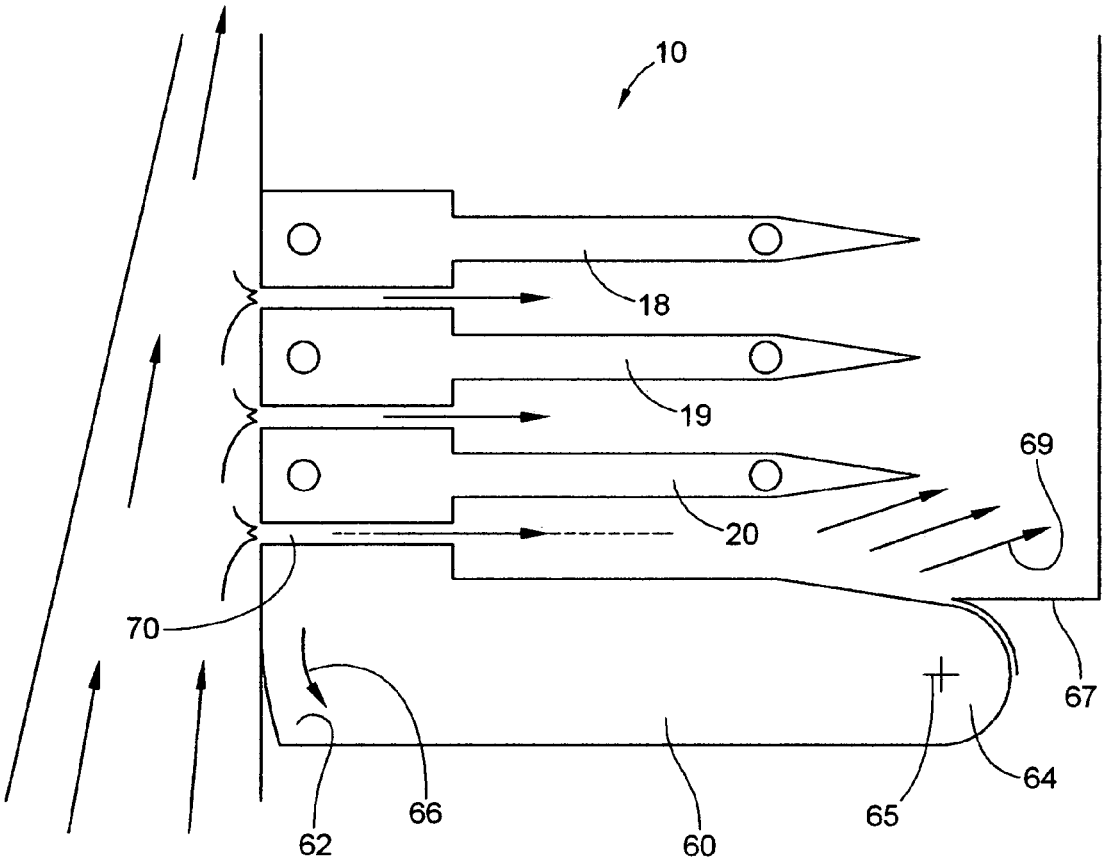
FIG. 12 is a similar view to that shown in FIG. 11 but shows the edge flow element pivoted to the "opened" disposition thereof.

FIG. 12 is a similar view to that shown in FIG. 11 but shows the edge flow element 60 pivoted to the "opened" disposition thereof so that there is a tendency for the stock to flow away from the pondside 67 as indicated by the arrow 69.

Figure 13:
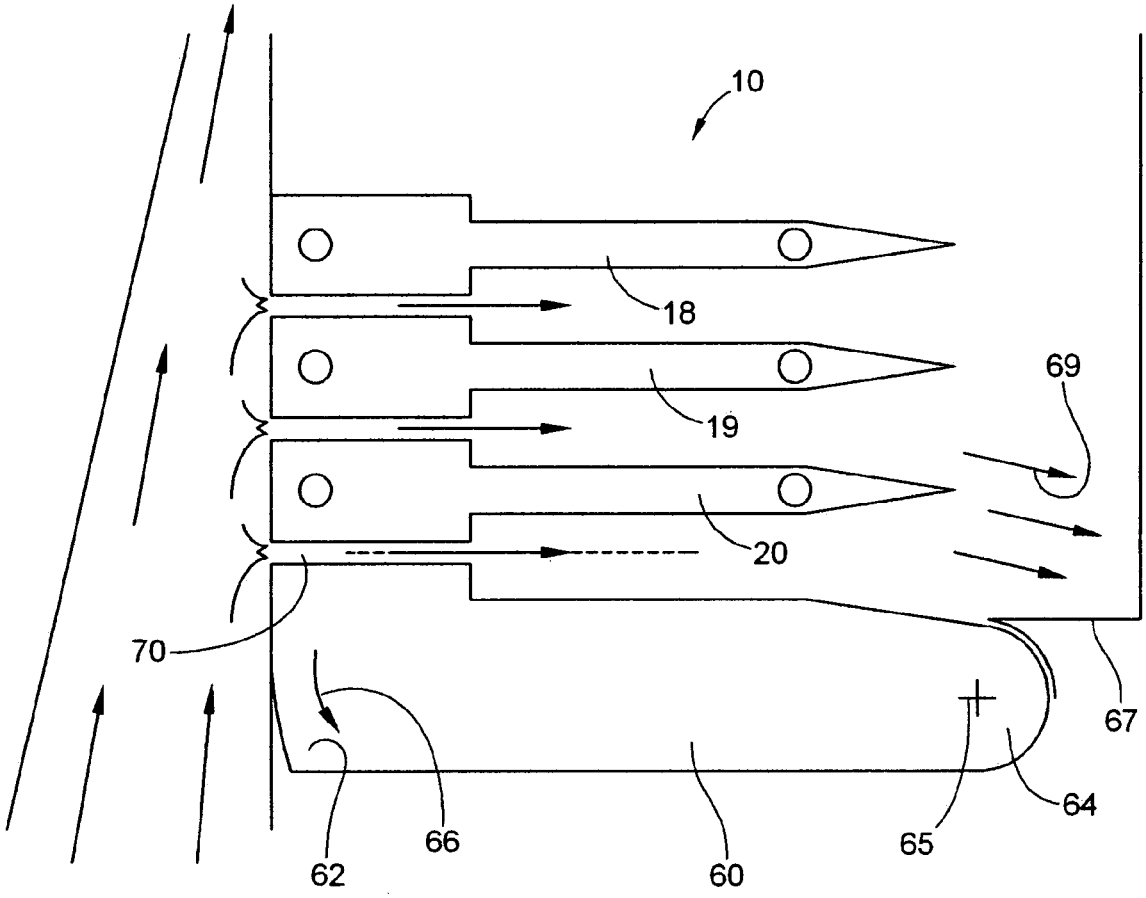
FIG. 13 is a similar view to that shown in FIG. 12 but shows the edge flow element pivoted to the "closed" disposition thereof.

FIG. 13 is a similar view to that shown in FIG. 12 but shows the edge flow element 60 pivoted to the "closed" disposition thereof so that there is a tendency for stock to flow towards the pondside 67 as indicated by the arrow 69.

Figure 14:
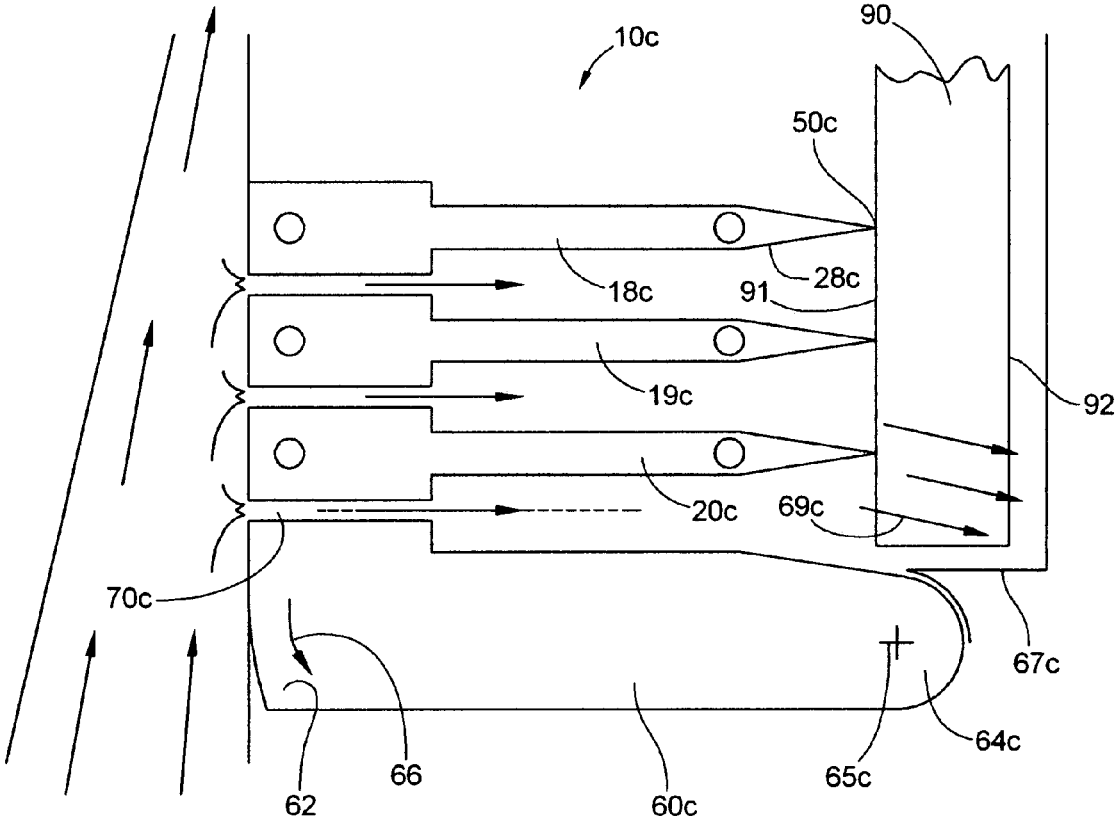
FIG. 14 is a similar view to that shown in FIG. 13 but shows a further variant which includes a trailing element.

FIG. 14 is a similar view to that shown in FIG. 13 but shows a further variant. As shown in FIG. 14, the headbox 10*c* includes a trailing element 90 having a proximal and a distal end 91 and 92 respectively. The proximal end 91 is pivotally secured adjacent to downstream extremity 50*c* of the downstream portion 28*c*.

Additionally, as shown in FIG. 1, the headbox 10 according to the present invention may include a dilution control 92 for controlling the cross machine consistency profile of the resultant web.

Figure 15:
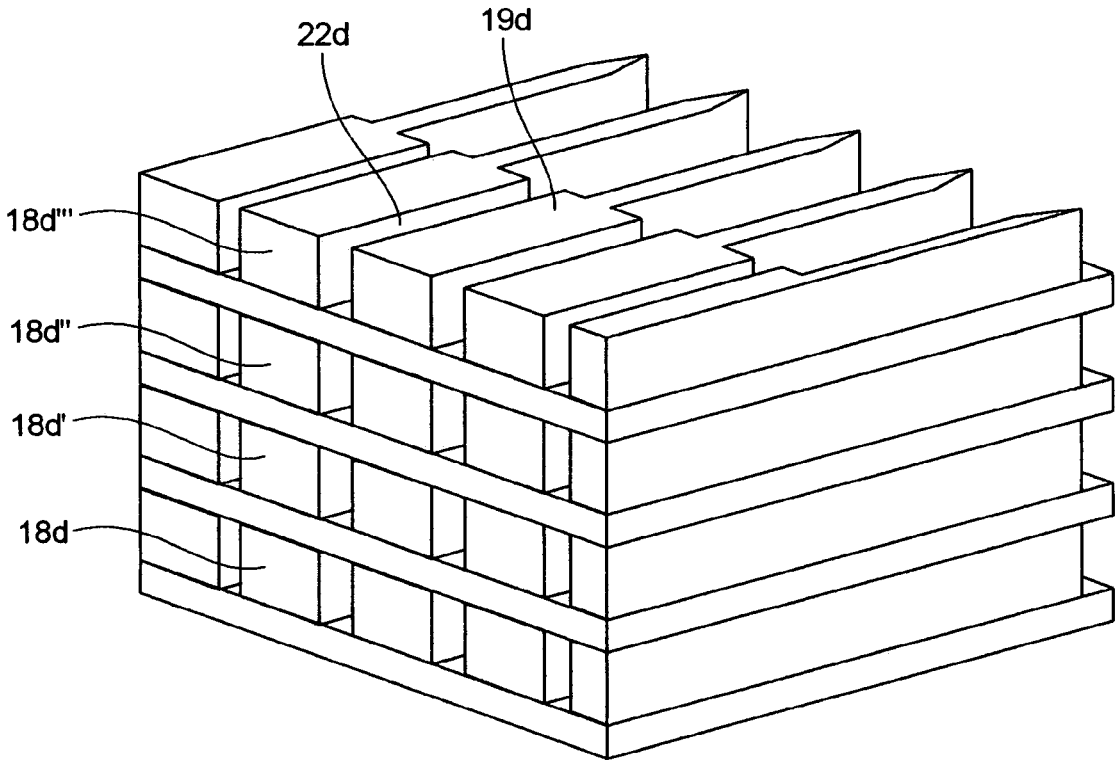
FIG. 15 is a perspective view of a further embodiment of the present invention.

FIG. 15 is a perspective view of a further embodiment of the present invention. As shown in FIG. 15, elements 18*d*, 18*d*', 18*d*" and 18*d*'" are arranged in vertical columns. Thus, the arrangement of FIG. 15 may be used for generating a multi-ply web.

Figure 16:
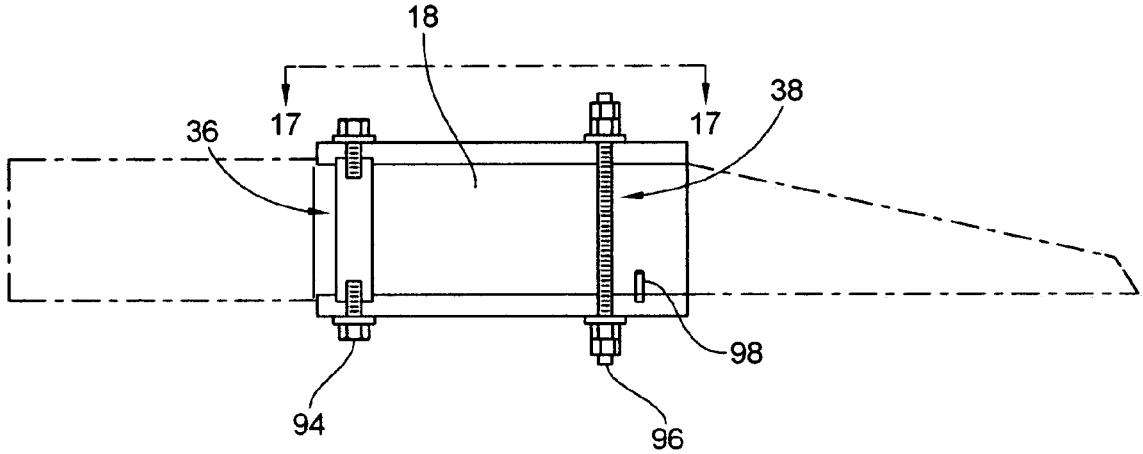
FIG. 16 is a sectional view of yet a further detail of the present invention.

FIG. 16 is a sectional view of yet a further detail of the present invention. As shown in FIG. 16, the rods generally designated 36 and 38 include a compression link 94 and a tension link 96 respectively. Also, an alignment pin 98 is provided.

Figure 17:
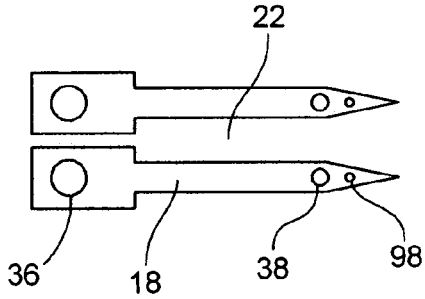
FIG. 17 is a view taken on the line 17-17 of FIG. 16.

FIG. 17 is a view taken on the line 17-17 of FIG. 16. As shown in FIG. 17, the element 18 is anchored by rods 36 and 38 and is aligned by the alignment pin 98.

Figure 18:
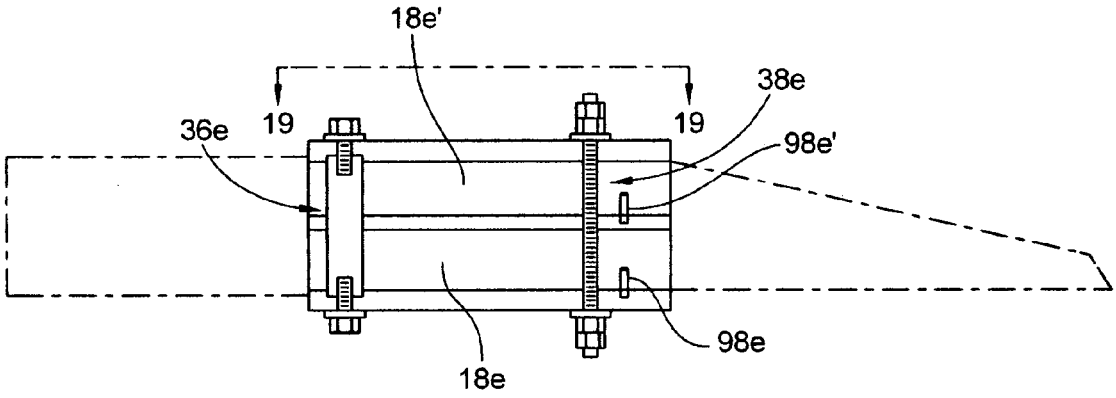
FIG. 18 is a sectional view of another embodiment of the present invention.

FIG. 18 is a sectional view of another embodiment of the present invention. As shown in FIG. 18, rods 36*e* and 38*e* are used to anchor elements such as elements 18*e* and 18*e*' together such as in the arrangement shown in FIG. 15. Alignment pins 98*e* and 98*e*' are used to align elements 18*e* and 18*e*'.

Figure 19:
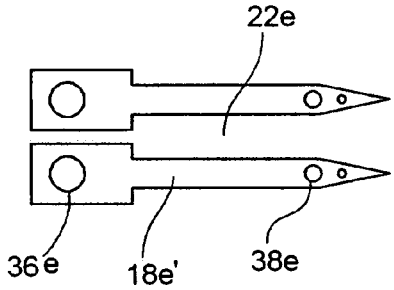
FIG. 19 is a sectional view taken on the line 19-19 of FIG. 18.

FIG. 19 is a sectional view taken on the line 19-19 of FIG. 18. As shown in FIG. 19, the element 18*e*' is anchored by rods 36*e* and 38*e*.

In operation of the apparatus 10, the stock flows through the flow tubes 22 so that the flow of stock is accelerated during passage thereof through the upstream portion 26 and decelerated during movement through the downstream portion 28 to form a stabilized vortex flow in the downstream portion 28.

The edge flow element 60 is adjusted to alter the direction of flow adjacent to the pondside 67 to control the edge formation of the resultant web.

In an alternative embodiment, as shown in FIG. 3, the edge element 20*a* is moved in a machine direction 72 to alter and control the vortex formation within the downstream portion 28*a* to achieve an optimum mixing of the stock to be ejected through the slice lip.

Although the present invention has been described in detail relative to a single row of flow tubes, the invention is equally applicable to an arrangement in which multiple columns of flow tubes are arranged in a tube bank as shown in FIGS. 15 and 18-19. Such vertical columns may be arranged with each flow tube aligned vertically relative to an adjacent flow tube. Alternatively each flow tube can be offset relative to an adjacent flow tube to form a non aligned column of flow tubes.

The present invention provides a unique tube bank for a headbox that considerably reduces the cost of manufacture of a headbox and which provides control advantages that are not available in conventional headboxes.

What is claimed is:

1. A headbox apparatus for a papermaking machine, said headbox apparatus defining a flow path for stock flowing between an upstream end and a downstream end, said apparatus comprising:

a plurality of elements which are anchored within the flow path between the upstream end and the downstream end, each of said elements having a first and a second side;

a side of each element and a side of an adjacent element of said plurality of elements defining therebetween a flow tube for the flow therethrough of the stock; and said flow tube having an upstream portion and a downstream portion that gradually widens in a direction from the upstream end to the downstream end.

2. A headbox apparatus as set forth in claim 1 wherein each of said elements is fabricated from a plastics material.

3. A headbox apparatus as set forth in claim 2 wherein said plastics material is a high molecular weight polyethylene.

4. A headbox apparatus as set forth in claim 1 wherein each of said elements is fabricated from a graphite composite.

5. A headbox apparatus as set forth in claim 1 wherein each of said elements is fabricated from fiberglass.

6. A headbox apparatus as set forth in claim 1 wherein each of said elements is fabricated from TEFLON.

7. A headbox apparatus as set forth in claim 1 wherein each of said elements is fabricated from ceramic material.

8. A headbox apparatus as set forth in claim 1 wherein each of said elements is fabricated from stainless steel.

9. A headbox apparatus as set forth in claim 1 wherein each element defines an upstream and a downstream bore;

a first anchor rod extending through said upstream bore;

a second anchor rod extending through said downstream bore such that said anchor rods anchor said element within the headbox apparatus.

10. A headbox apparatus as set forth in claim 9 wherein the upstream end is a header and the downstream end is a slice lip.

11. A headbox apparatus as set forth in claim 10 wherein said anchor rods extend substantially normal to said direction from the header to the slice lip.

12. A headbox apparatus as set forth in claim 1 wherein said first side is of mirror image configuration relative to said second side.

13. A headbox apparatus as set forth in claim 1 wherein each element is disposed in alignment in said direction relative to said adjacent element.

14. A headbox apparatus as set forth in claim 1 wherein each element is disposed out of alignment in said direction relative to said adjacent element such that said element and said adjacent element are offset relative to each other.

15. A headbox apparatus as set forth in claim 1 wherein said flow tube extends in said direction.

16. A headbox apparatus as set forth in claim 1 wherein said upstream portion is of rectangular cross sectional configuration.

17. A headbox apparatus as set forth in claim 1 wherein said upstream portion has a height which is greater than a width of said upstream portion.

18. A headbox apparatus as set forth in claim 1 wherein said upstream portion has an upstream and a downstream end, said upstream portion being of uniform cross sectional configuration between said upstream and downstream ends thereof.

19. A headbox apparatus as set forth in claim 18 further including:

an intermediate portion of said flow tube, said intermediate portion having a first and a second end, said intermediate portion being disposed between said upstream portion and said downstream portions of said flow tube;

said downstream end of said upstream portion defining a chamfered transition which is disposed adjacent to said first end of said intermediate portion such that the stock flows through said upstream portion through said chamfered transition and through said intermediate portion and through said downstream portion.

20. A headbox apparatus as set forth in claim 1 wherein said downstream portion has an upstream extremity and a downstream extremity, said upstream extremity of said downstream portion having a cross sectional area which is greater than a cross sectional area of said upstream portion.

21. A headbox apparatus as set forth in claim 20 wherein said cross sectional area of said downstream portion progressively increases in said direction between said upstream and said downstream extremities of said downstream portion.

22. A headbox apparatus as set forth in claim 1 wherein said upstream extremity of said downstream portion has a cross sectional area which is less than a cross sectional area of said downstream extremity.

23. A headbox apparatus as set forth in claim 20 further including:

a trailing element having a proximal and a distal end, said proximal end being pivotally secured adjacent to said downstream extremity of said downstream portion.

24. A headbox apparatus as set forth in claim 1 further including:

an edge flow element having an upstream and a downstream termination, said edge flow element being pivotally anchored adjacent to said downstream termination thereof such that selective pivotal movement of said edge flow element is permitted so that a cross sectional area of an edge flow tube defined between said edge flow element and an adjacent element of said plurality of elements is selectively adjustable.

25. A headbox apparatus as set forth in claim 1 further including:

a dilution control for controlling the cross machine consistency profile of the stock flowing through the downstream end of the headbox apparatus.

26. A headbox apparatus for a papermaking machine, said headbox apparatus defining a flow path for stock flowing between an upstream header and a downstream slice lip, said apparatus comprising:

a plurality of elements which are anchored within the flow path between the header and the slice lip, each of said elements having a first and a second side;

a side of each element and a side of an adjacent element of said plurality of elements defining therebetween a flow tube for the flow therethrough of the stock;

said flow tube having an upstream portion and a downstream portion that gradually widens in a direction from the header to the slice lip; and said downstream portion has an upstream extremity and a downstream extremity, said upstream extremity of said downstream portion having a cross sectional area which is greater than a cross sectional area of said upstream portion.

27. A headbox apparatus for a papermaking machine, said headbox apparatus defining a flow path for stock flowing between an upstream header and a downstream slice lip, said apparatus comprising:

a plurality of elements which are anchored within the flow path between the header and the slice lip, each of said elements having a first and a second side;

a side of each element and a side of an adjacent element of said plurality of elements defining therebetween a flow tube for the flow therethrough of the stock;

said flow tube having an upstream portion and a downstream portion that gradually widens in a direction from the header to the slice lip;

each of said elements being fabricated from a plastics material;

said plastics material being a high molecular weight polyethylene;

each element defining an upstream and a downstream bore;

a first anchor rod extending through said upstream bore;

a second anchor rod extending through said downstream bore such that said anchor rods anchor said element within the headbox apparatus;

said anchor rods extending substantially normal to said direction from the header to the slice lip;

each element having a first and a second side, said first side being of mirror image configuration relative to said second side;

each element being disposed in alignment in said direction relative to said adjacent element;

said flow tube extending in said direction;

said upstream portion being of rectangular cross sectional configuration;

said upstream portion having an upstream and a downstream end, said upstream portion being of uniform cross sectional configuration between said upstream and downstream ends thereof;

said downstream portion having an upstream extremity and a downstream extremity, said upstream extremity of said downstream portion having a cross sectional area which is greater than a cross sectional area of said upstream portion;

said upstream extremity of said downstream portion having a cross sectional area which is less than a cross sectional area of said downstream extremity;

said cross sectional area of said downstream portion progressively increasing in said direction between said upstream and said downstream extremities of said downstream portion;

an intermediate portion of said flow tube, said intermediate portion having a first and a second end, said intermediate portion being disposed between said upstream portion and said downstream portions of said flow tube;

said downstream end of said upstream portion defining a chamfered transition which is disposed adjacent to said first end of said intermediate portion such that the stock flows through said upstream portion through said chamfered transition and through said intermediate portion and through said downstream portion; and an edge flow element having an upstream and a downstream termination, said edge flow element being pivotally anchored adjacent to said downstream termination thereof such that selective pivotal movement of said edge flow element is permitted so that a cross sectional area of an edge flow tube defined between said edge flow element and an adjacent element of said plurality of elements is selectively adjustable.

* * * * *